United States Patent [19]

Rempel

[11] 4,058,196

[45] Nov. 15, 1977

[54] PRINTER WITH INTERCHANGEABLE PAPER-FEED MODULES

[75] Inventor: William D. Rempel, Howell, Mich.

[73] Assignee: Sycor, Inc., Ann Arbor, Mich.

[21] Appl. No.: 660,257

[22] Filed: Feb. 23, 1976

[51] Int. Cl.[2] ..... B41J 15/04

[52] U.S. Cl. ..... 197/133 R; 197/133 P

[58] Field of Search ..... 197/126, 132, 133 P, 197/133 R, 134; 226/52, 55; 74/458

[56] References Cited

U.S. PATENT DOCUMENTS

| | | | |
|---|---|---|---|
| 2,059,879 | 11/1936 | La Pierre | 197/133 P |
| 2,302,704 | 11/1942 | Mabon | 197/133 P |
| 2,355,668 | 8/1944 | Morse | 197/133 P |
| 2,424,073 | 7/1947 | Ayres | 197/133 R |
| 2,476,449 | 7/1949 | McDonnell | 197/133 R |
| 2,482,108 | 9/1949 | Hageman | 197/133 P |
| 2,819,782 | 1/1958 | Metzner et al. | 197/133 P |
| 3,327,548 | 6/1967 | Welch | 74/462 |
| 3,707,214 | 12/1972 | Ponzano | 101/93.16 |
| 3,728,907 | 4/1973 | Stade | 74/458 X |
| 3,787,884 | 1/1974 | Demer | 197/133 R |

FOREIGN PATENT DOCUMENTS

| | | | |
|---|---|---|---|
| 825,154 | 12/1959 | United Kingdom | 197/133 P |
| 847,148 | 9/1960 | United Kingdom | 197/133 P |

*Primary Examiner*—Louis G. Mancene
*Assistant Examiner*—Paul J. Hirsch
*Attorney, Agent, or Firm*—Price, Heneveld, Huizenga & Cooper

[57] ABSTRACT

A data printer having removable, and interchangeable, paper-feed modules, such as may embody a tractor or pin-feed-type paper-feed mechanism. The interchangeable modules each have guide ways which cooperate with and move along complementary guideways supported by the printer main frame to guide the selected module into place and seat it in a particularly defined position. A mechanical latch locks the seated module to maintain it in place. The paper-feed mechanism of each module is driven by a rotatable member, with the power train including a motor-driven worm mounted on the printer and a mating worm-gear carried on the removable paper-feed module. The worm is mounted in an upright position, and the worm-gear moves into mating relation with the worm by travelling an upright path, but with a small acute angle between such paths. The worm and worm-gear have a tooth or thread profile with a rounded nose section.

27 Claims, 9 Drawing Figures

PRINTER WITH INTERCHANGEABLE PAPER-FEED MODULES

BACKGROUND OF THE INVENTION

In the use of data printers generally, and particularly in those of sufficiently simple design to be economically feasible for purchase or lease by an average-size business enterprise, which may require a printer capability to complement a data entry terminal, it is often desired to use a variety of different types of business forms as the printing medium. However, such forms are usually so different in nature that they will not fit the same paper-feed mechanism, frequently a tractor, or sometimes a pin-feed mechanism. Nonetheless, in the past, printers have mainly had only a single type of permanently-mounted paper drive, and the needed flexibility to accommodate differently-sized forms has not been available, largely because of the difficulties in obtaining paper-feed module interchangeability while maintaining the needed structural integrity and operational consistency. This is particularly true because the most common type of such printer is an impact device having a reversing or reciprocating carriage of some type, which is subject to substantial vibration and shock during use, which tends to shake, weaken and loosen all but extremely rigid and permanently-anchored components.

Thus, the need has been present for some time for greater flexibility in such printers, in the way of convertible or interchangeable paper-feed mechanisms, but this need has of yet remained largely unfilled.

BRIEF SUMMARY OF THE INVENTION

The present invention answers the foregoing need and provides a data printer structure by which ready removeability and complete interchangeability is achieved for the paper-feed apparatus, by means of interchangeable paper-feed modules, each carrying a different type of paper-feed mechanism, as well as preferably carrying its own platen, which is thus changed with the paper-feed module.

The printer has an outer housing and a support structure or frame within the housing, for the printer mechanism. This support frame defines or carries a mounting bed for the paper-feed modules. The modules preferably comprise a pair of side plates with at least one interconnecting support member and a paper-feed apparatus mounted between the side plates, such apparatus including a platen, which may or may not be rotatable, and a rotatable element with associated means for engaging paper stock and moving the same lengthwise. The rotatable element comprise a rotary drive element which when the module is seated on the printer frame engages a complementary motor-driven member mounted on such frame. Seating of the module is achieved by complementary guideways cooperating between the module and the printer frame, by which the module may be slid upon a guide into accurately indexed position, where an interlock will hold it securely in position. Most preferably, the printer-mounted power drive comprises a motor-driven worm which is oriented generally vertically, and the paper-feed module has a mating worm-gear which is moved into a position engaging the worm by the guided seating movement of the paper-feed module, which preferably is along a path disposed at a small acute angle relative to the worm axis. Both the worm thread and the worm gear teeth should have a profile with a curved outer tip, so that as the paper feed module is moved toward and into its seated position the worm gear moves toward and engages the worm, with the rounded tips of the engaging gear teeth and worm thread sliding off one another in the event of interfering alignment, to prevent tooth breakage.

The many advantages of the invention, together with its objectives, will become more apparent from a study of the ensuing Specification and the attached drawings.

DESCRIPTION OF PREFERRED EMBODIMENTS

Figure 1:
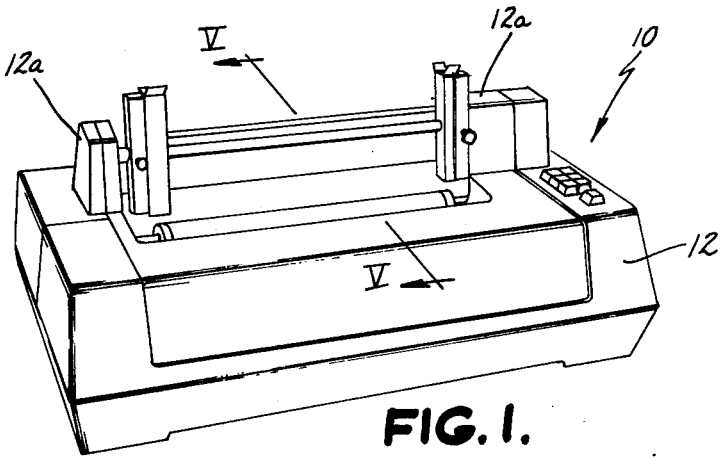
FIG. 1 is a front perspective view of a printer in accordance with the invention embodying a tractor-type paper-feed mechanism.
Figure 2:
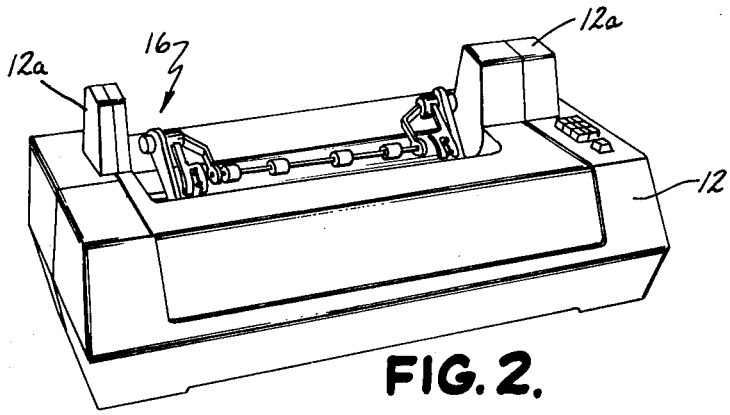
FIG. 2 is a front perspective view similar to FIG. 1 but showing the printer with a pin-feed-type paper-feed module in operative position.

Referring now in more detail to the drawings, the printer 10 has an outer housing 12 with a removable upper portion **12*a* which encloses the end portions of a removable and interchangeable paper-feed modules, shown in FIG. 1 to embody a tractor-type paper-feed mechanism 14 and in FIG. 2 to embody a pin-feed type mechanism 16**, each to be described more particularly hereinafter.

Figure 3:
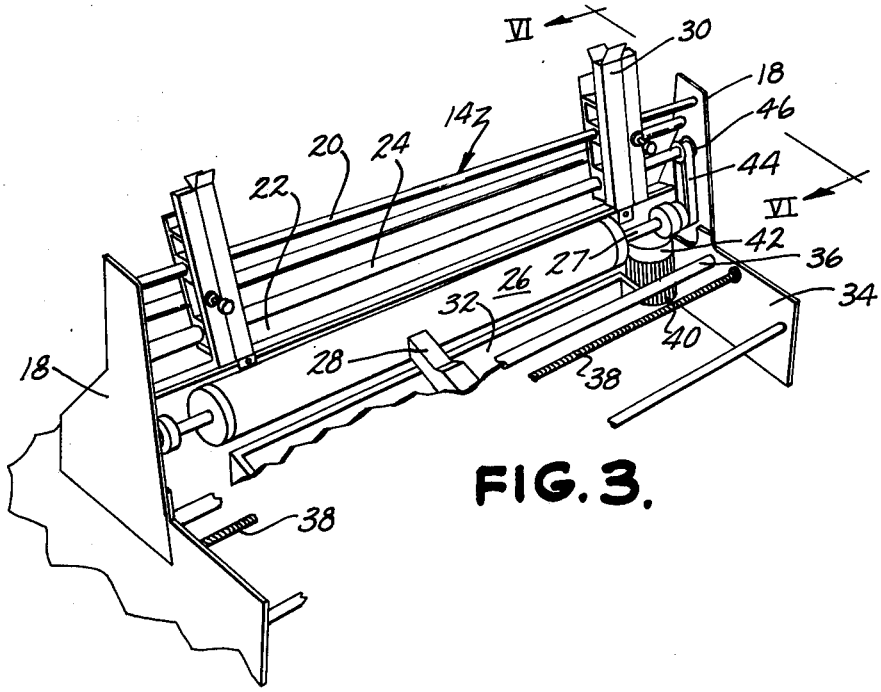
FIG. 3 is fragmentary perspective view of the embodiment of FIG. 1 shown without the outer housing.

The tractor module 14 is seen in more detail in FIG. 3, as is part of the structure of the printer apparatus. Preferably, this module (like the others) has a basic structure comprising a pair of spaced upright side plates which are joined into a generally rigid unit by elongated interconnecting members. In the case of the tractor module 14, side plates 18 are joined together by an upper guide bar 20 of straight, round stock, and a generally L-shaped or other such reinforcing interconnecting support 22, which may be extruded aluminum. The side plates carry a rotatably-mounted, splined driving shaft 24, and a platen 26, which also is preferably rotatable (but not necessarily driven). A print head 28 may be moved laterally across the front of the platen so as to print characters on paper stock fed between the print head and the platen, the paper being pulled upwardly by the tractor devices 30. The paper preferably passes through and is guided by an elongated opening 32 defined by the internal frame work of the printer, which for present purposes may be regarded generally as a rigid, supportive base structure upon which the outer housing 12 is mounted as a protective enclosure which also gives shape and appearance to the device generally. It is to be understood that the tractor devices 30 are well known commercially available paper-handing components, obtainable from a number of different manufacturers, including for example Kidder-Machinery Div., Moore Business Firms Co.

The paper-feed modules are preferably mounted upon spaced side plates 34 comprising part of the internal support structure or frame of the printer, between which extend such elements as a rigid guide bar 36 and a rotatably mounted lead screw 38 which may be used to move the print head structure 28, all as disclosed in more detail in copending application Ser. No. 725,690, Filed Sept. 23, 1976, entitled Carriage Suspension And Frame Aseembly For Impact Printers And The Like. The side plate 34 illustrated at the right side in FIG. 3 also mounts a generally vertically-disposed drive motor 40, preferably a stepping motor, which is used to drive the paper-feed module, e.g. in the embodiment of FIG. 3 to rotate a cluster gear 42 and thereby drive the belt 44, which turns the driving shaft 24 through a toothed pulley 46 attached to such shaft. Rotation of the latter drives the tractors 30. Also, the upright side plates 34 of the printer define a supportive mounting bed for the interchangeable paper feed modules 14 or 16, each of which is removably mounted on such support bed. In the case of the tractor module 14 shown in FIG. 3, the drive gear 42 is preferably rotatably carried on a fixed shaft 27, on which the platen 26 is also rotatably mounted, for random (undriven) rotation during paper advancement.

Figure 4:
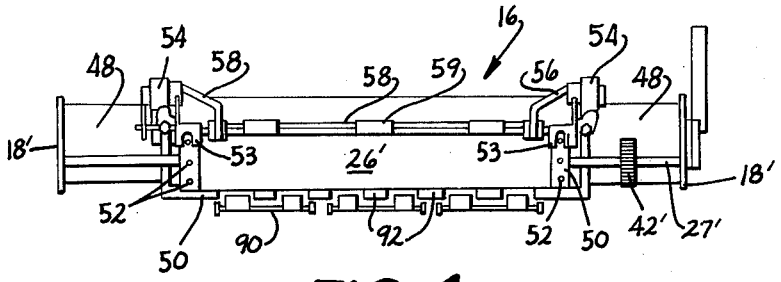
FIG. 4 is a front elevational view of the pin-feed module.

One example of a pin-feed-type module 16 is seen in more detail in FIG. 4. As already stated, this module is preferably similar in a basic structural sense to the tractor module 14, and it has the same length, as well as a pair of similar side plates 181, between which extend lateral supports analogous to the guide bar 20, and rigidifying support 22 of FIG. 3, together with a platen 26' mounted on a shaft 27'. In this module, the lateral support members preferably mount a downwardly-depending sheet metal or like paper guide 48 which lies behind the platen 26' and generally parallel to the guideways 60 (FIG. 5) (to be discussed subsequently), for the purpose of guiding paper through a space between the guide and the platen. The platen itself is of a known type, being a hard but resilient rubber-like roller element which in this embodiment is secured to its support shaft for rotation therewith, upon rotation of drive gear 42' secured to shaft 27'.

The platen has a pair of end portions 50 which define pin-feed mechanisms, comprising in effect a dish-like structure having an apertured tubular periphery through which protrude drive pins 52, which engage holes along the edge of the paper to be printed, to thereby draw it upwardly. The pin feed elements 50 are known commercially available mechanisms, which preferably have an internal eccentric cam apparatus which actuates the pins 52 outwardly at the point where they must project to engage the holes in the paper to be fed, but which retracts the pins during other portions of each revolution of the platen. Attached to the platen and pin feed mechanism at each end is a bail support member 54, which may hook over or hang upon the upper edge of the paper guide 48, and which has arms 56 supporting a paper hold-down bail 58 having a series of cylindrical friction rollers 59. Also, the support members 54 include dependent arms having guide finger portions 53 which hold and guide the paper adjacent the feed pins 52 for trouble-free feeding. The pin-feed module may if desired include friction-feed roller elements such as those indicated at 90 and 92, which may be of a generally known nature analogous to those usually found on typewriters or the like. While the specific nature of such mechanism is not of itself a central aspect of this invention, it may be noted that the rollers 92 may conveniently be mounted along a common support shaft and positioned in contact with the platen, to be rotated by the latter, while the rollers 90 are preferably arranged in sets (e.g., groups of two) which are pivotally mounted independently from one another so as to be self-aligning with the rollers 92, to feed paper therebetween upon rotation of the latter by the platen. It is also to be noted that, in accordance with the concept hereof, such a friction-feed mechanism may be implemented as a wholly separated module, distinct from the pin feed (or tractor) module, but based on the same underlying structural concept and also interchangeable with the other modules.

Each of the paper-feed modules just described thus comprises a light weight, self-contained paper feed mechanism which can readily be removed from or placed into position upon the support bed defined by the frame of the printer, as mentioned previously. Each such module has its own different type of paper-feed mechanism, as well as its own platen, (although it may be desired to practice the basic concept thereof by using a common platen, which remains mounted upon the printer frame rather than being a part of the paper feed modules and removable therewith), together with sufficient structural support to provide a relatively rigid structure suitable for functional operation when used upon a supportive frame which helps it maintain its shape, without substantial load or stress application. The providing of such an apparatus, including the basic printer mechanism with its supportive main frame, with light-weight, modularized, interchangeable paper-feed modules of a simple structural nature, is an important aspect and objective of the invention. In this connection, it is to be noted that to enchance removability and interchangeability, and the real practicality of such features, it is desirable to exclude from the removable structure many components which are usually mounted upon conventional fixed paper feed structure, including for example electronic components and circuitry in general, controls, sensors, tab or margin mechanisms, motors, encoders, paper switches, and the like, all of which when present as part of the paper-feed module serve to make removability a very complicated and difficult matter, and which need not be made part of the paper-feed apparatus, or module, it being entirely feasible, and indeed within the concept of this invention, to embody such elements in, or on, the main frame of the printer.

Figure 5:
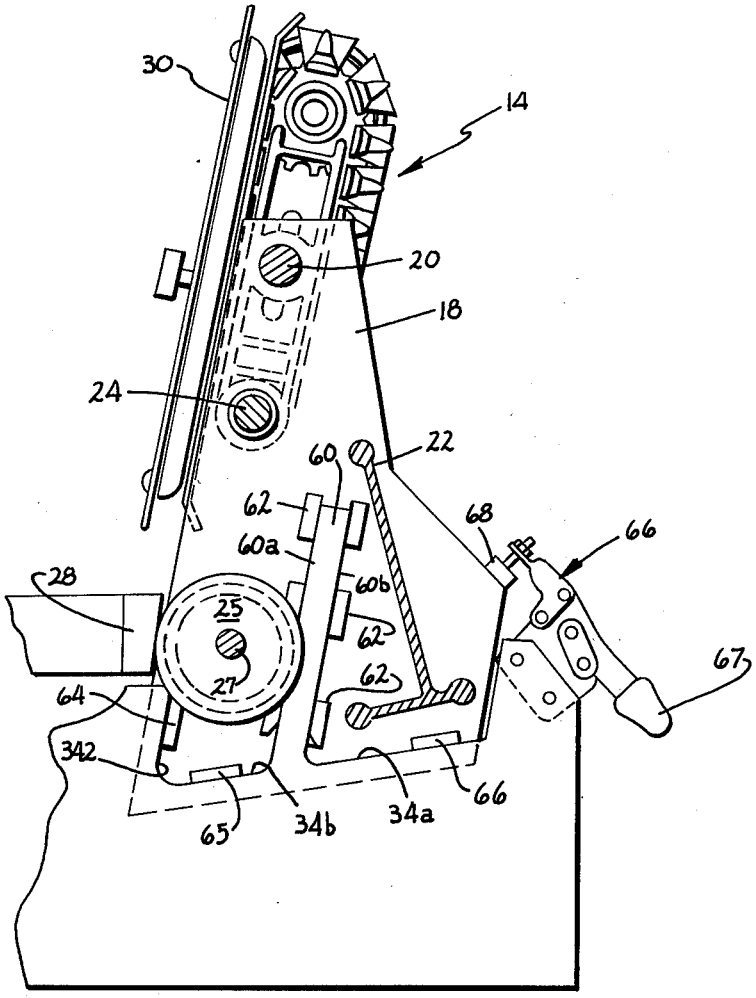
FIG. 5 is an enlarged, fragmentary side elevational view taken along the plane V—V of FIG. 1, showing the guideways for placement and seating of the paper feed modules, as well as other details.

The manner in which the paper-feed modules fit into and are held in mounted position is seen in more detail in FIG. 5, in which the tractor module 14 is illustrated as typical of either such module in this respect. First, the side plates 34 of the printer frame are shaped to define a pair of adjacent cut-away or recessed portions separated by an elongated, upstanding, rearwardly-angled guide tongue 60, whose two opposite elongated sides thus define guide surfaces **60*a* and 60*b*, as do edge portions 34*a*, 34*b*, 34*c* of the cutouts in the side plates 34. Mounted on the inwardly-facing side of each of the paper feed module side plates 18 are a series of guide blocks 62, which in effect define a guide channel or path for receiving guide tongue 60, together with guide blocks 64, 65 and 66, the first of which guides along and rests against the upright guide surface 34***a*, while the other two of which seat downwardly against the top edges 34*b* and 34*c* of the side plates 34, to index the paper-feed module in seated position thereupon. When so seated, a toggle-type or other such latching element 66, which is secured to the upper edge of each main frame side plate 34, is actuated by its respective handle 67 to bring a resilient locking pad 68 into locking contact against the upper edge of the paper feed module side plate 18, thereby locking the entire paper feed module into place. As illustrated, in this position the platen 26, mounted on and carried by the paper feed module, is positioned immediately adjacent and in direct alignment with the print head 28, which is carried by the printer main frame. The tractor mechanisms 30 are thus disposed above the platen, as already shown and described, slidably mounted upon the upper guide bar 20 and the splined driving shaft 24.

Accordingly, it may be seen that the entire paper feed module may be readily removed or placed into position, or interchanged, by merely actuating each of the taggle clamps to release them, which swings their locking head portions 68 clear of the rear edge of the module side plates, and then lifting the entire module upwardly and out of the printer, during which the guide blocks 62 slide upwardly along guide surfaces 60*a* and 60*b*, until the module is clear.

Figure 6:
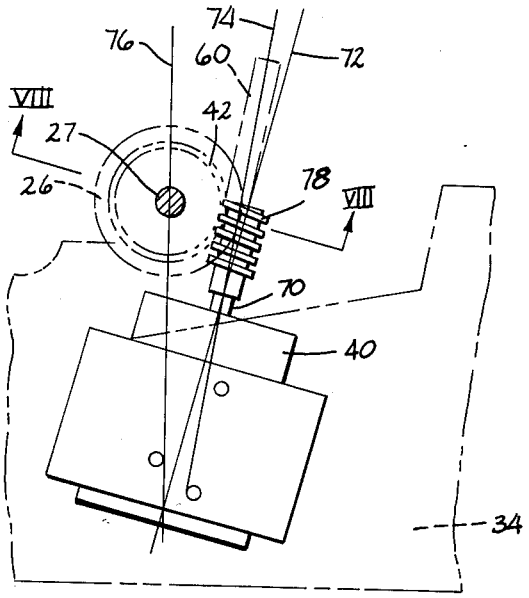
FIG. 6 is an enlarged, fragmentary side elevational view showing the worm-gear drive train.

FIG. 6 shows the mounting and positioning of the components which drive the paper-feed module, in relation to other parts of the apparatus already discussed. Thus, the drive motor 40 is seen in its position relative to the printer main frame side plate 34, and the guide tongue 60 thereof, discussed just above. It will be noted that the drive motor 40 (preferably, a stepper motor) is attached to side plate 34 with the motor output shaft 70, having its axis of rotation 72 oriented at a rearward inclination (relative to the front of the printer), in the same general direction as the angle of the guide tongue 60, represented by reference line 74, but at a greater acute angle relative to true vertical, (with the printer in its normal operating position), as illustrated, true vertical being represented by the reference line designated 76.

Rotational drive from motor 40 is most preferably imparted to the paper feed module by a worm-gear drive since this provides certain advantages over other potentially useable drive systems such as a spur gear train. For example, a spur gear system would require multiple gears, thereby adding considerable expense by way of additional parts and machining during manufacture, as well as additional skilled labor for assembly; furthermore, a spur gear train would require that the axis of the drive motor be parallel to that of the platen, which can lead to packaging problems. In the preferred worm gear drive illustrated in the figures, the motor shaft 70 has a drive worm element 78 secured thereto. Worm 78 engages the teeth of a mating gear 42 carried on the paper feed module (designated 42' on the pin-feed module), to effect a drive coupling between the printer main frame and the paper-feed modules. In the case of the tractor module such rotary motion is coupled by the belt 44 to the splined tractor-drive shaft 24, as pointed out above.

With the foregoing structure, as either of the paper-feed modules is slid along the guide paths, or guide-ways, discussed above, into seated relation upon the printer main frame bed, the worm gear 42 mounted on the platen shaft 27 is moved downwardly along a path parallel to the guide path reference line 74, with the tips of the gear teeth following such reference line. Thus, the worm gear moves along a path which converges with the axis of rotation 72 of the worm, thereby bring the tips of the worm gear teeth gradually into engagement with the thread of the worm. This is an important aspect of the paper-feed modules interchangeability, particularly since it is important that easy and trouble free interchangeability and gear meshing always occur, without any prospect of gear interference or tooth tip binding.

The desired type of gear closure and mating is most preferably achieved in accordance with the invention by disposing the axis of rotation 72 for the worm and drive motor at an angle of approximately fifteen degrees relative to the vertical, i.e., reference line 76, while disposing the guide path reference line 74 at a smaller acute angle, preferably on the order of about 10°, relative to the vertical reference line. Thus, a small acute angle, preferably on the order of about 5°, but at least within the range of about 3 or 4° to about 20°, exists between the axis of the worm and that of the worm gear, and it is along one of those two mutually converging axes that the worm gear is moved into mating relation with the worm as the paper-feed module is moved into position on the printer.

Figure 7:
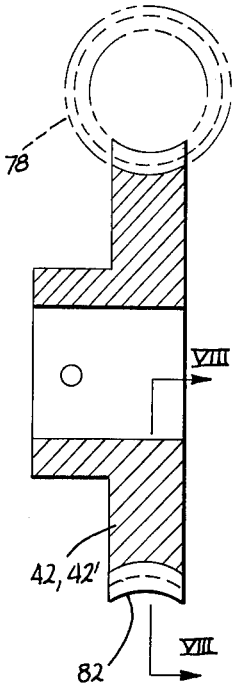
FIG. 7 is an enlarged, central sectional elevation of the worm gear, with the worm diameter shown in phantom.
Figure 9:
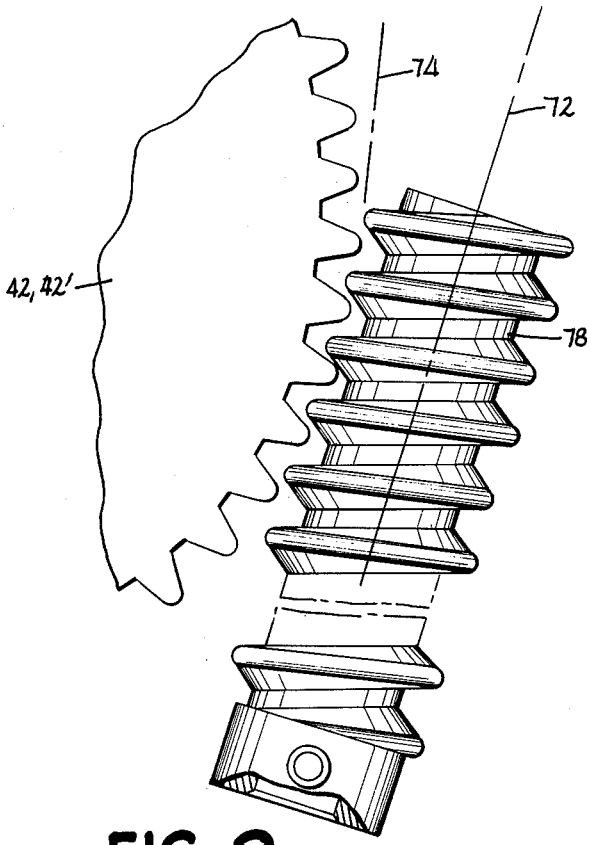
FIG. 9 is an enlarged, fragmentary side elevational view showing the engagement of the worm and worm gear.
Figure 8:
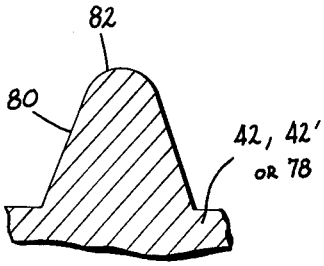
FIG. 8 is an enlarged, fragmentary sectional elevation taken through the plane VIII—VIII of FIG. 7, showing the tooth profile of the gear.

The angularly-disposed relationship just described is provided to help insure consistent, trouble-free mating engagement of the worm and gear when the paper feed modules are placed in position upon the printer. Furthermore, the relative size and shape of the worm and its thread, and that of the worm gear, are preferably as illustrated in FIGS. 7–9 inclusive. First, the worm gear preferably has an overall diameter on the order of two or three times that of the worm, but with each having the rounded tooth or thread profile shown in FIG. 8, i.e., having straight, angularly-disposed sides 80 defining a pressure angle of about twenty degrees, and with a rounded nose section 82. For a specific set of values corresponding to the angular converging axial relationships set forth above, the worm gear may have an O.D. of 1.521 inch, a pitch diameter of 1.375 inch, with a pitch of 24, preferably in a throated-type spur gear, while the worm may have an O. D. of 0.583 inch, a pitch circle diameter of 0.5 inch, a normal diametral pitch of 24 and an axial pitch of 0.13 inch. This produces the mating relationship from FIG. 9, from which it may be appreciated that it is virtually impossible for the teeth of the worm gear to be wedged tip-to-tip against the teeth of the worm when the paper-feed module is slid into position and seated, since the closing angle and the shape and size of the gear teeth and worm thread will always cause the worm gear (which is freely rotatable with the platen shaft during mounting of the module) to make first contact with the worm either along their sides, in mating relation, or at the curved nose sections of the gear teeth and worm thread, at any possible position of relative rotation between the two where initial contact may be made. Such that the worm gear merely rotates whatever small extent may be necessary to smoothly engage its teeth into the worm thread.

It is entirely conceivable that upon examining the foregoing disclosure, those skilled in the art may devise embodiments of the concept involved which differ somewhat from the embodiments shown and described herein, or may make various changes in structural details to the present embodiment. Consequently, all such changed embodiments or variations in structure which utilize the concepts of the invention and clearly incorporate the spirit thereof are to be considered within the scope of the claims appended herebelow, unless these claims by their language specifically state otherwise.

The embodiments of the invention in which an exclusive property or privilege is claimed are defined as follows:

1. A data printer with removable modular paper-feed assembly, comprising: a main support frame structure for the printer; print head means movable relative to at least portions of said frame structure so as to print lines of characters on paper fed by said paper-feed assembly; means carried on said frame structure defining an elongated guideway having longitudinal guide surfaces and means defining limiting and positioning surfaces for a module guided by said guide surfaces; drive means carried by said frame structure, including a motor and a rotatable output drive member; at least one modular paper-feed assembly having side wall sections, at least one support extending between the side wall sections, and movable paper-engaging-and-feeding apparatus mounted between the side wall sections, said feeding apparatus including a continuously movable member having means for engaging and moving paper stock and a rotational drive element coupled to such member for imparting movement thereto; means for releasably and detachably mounting said modular paper-feed assembly upon said frame structure, said means including a follower structure for said elongated guideway, said follower structure carried with said paper-feed assembly and being complementary to and movable longitudinally along said frame structure guide surfaces, said mounting means also having portions cooperatively seatable against said limiting and positioning surfaces to index the paper-feed assembly in a particularly defined position upon the frame structure said guideway and guideway follower being disposed and positioned to define a path of movement for said paper-feed assembly which brings the drive element of the latter angularly toward and into driving engagement with the output drive member of the drive means motor carried by the frame structure when the said limiting and positioning surfaces have indexed the paper-feed assembly in said particularly defined position; and interlock means having a locking element carried on one of said frame structure and said paper-feed assembly and a locking element-engaging portion carried on the other thereof for mutual locking engagement between said paper-feed assembly and said frame structure in said seated, indexed position, said locking engagement rigidly securing said paper-feed assembly in place upon the frame structure and holding said output drive member of the frame structure drive means engaged with said drive element of the paper-feed module, such that actuation of the motor produces movement of said paper-feeding apparatus through the interengaged output drive member and paper-feed assembly drive element.

2. The data printer of claim 1, and including a second modular paper-feed assembly also having side wall sections, at least one support extending between the side wall sections, and a paper-feeding apparatus mounted between the side walls and including a rotatable member having a second and different means for engaging paper stock and moving same lengthwise, said member having a rotary drive element coupled thereto for imparting rotation to the member; means for detachably mounting said second paper-feed assembly upon said frame structure and including a follower for the guideway of said frame structure and portions cooperatively seatable against said limiting and positioning surfaces for indexing the second paper-feed assembly in a similar particularly defined position upon the frame structure; said rotary drive element of said second paper-feed assembly engaging said rotatable output drive member of said frame-carried drive means when said second paper-feed assembly is brought into said indexed position, such that actuation of the drive means then produces rotation of said rotatable member through the interengaged output drive member and drive element, said second modular paper-feed assembly having interlock means substantially like those of the first paper-feed assembly for substantially the same locking engagement with the frame structure in the seated, indexed position of the second paper-feed assembly wherein the drive element of the latter is held engaged with the output drive member of the frame structure drive means, whereby said two modular paper-feed assemblies are interchangeable with one another upon said frame structure.

3. The apparatus of claim 1, wherein said paper-engaging-and-feeding apparatus of said one paper-feed assembly comprises a tractor mechanism driven by said rotational drive element, said motor and interengaged output drive member and rotational drive element imparting driving power to said tractor mechanism.

4. The apparatus of claim 2, wherein said paper-feeding apparatus of said second paper-feed assembly comprises a pin-feed mechanism driven by said rotary drive element, said motor and said interengaged output drive member and rotary drive element serving to drive said pin feed mechanism.

5. The apparatus of claim 4, wherein said paper-engaging-and-feeding apparatus of said one paper-feed assembly comprises a tractor mechanism driven by said rotational drive element, said motor and said interengaged output drive member and rotational drive element serving to drive said tractor mechanism.

6. The apparatus of claim 5, wherein said output drive member of said motor means comprises a worm element coupled to said motor, said rotational drive element of said paper-feed apparatus comprising a worm-gear engageable with said worm element.

7. The apparatus of claim 1, wherein said output drive member of said motor means comprises a worm element coupled to said motor, said rotational drive element of said paper-feed apparatus comprising a worm-gear which engages and disengages with said worm element when said removable modular paper-feed assembly is moved into and out of seated and indexed position upon said frame structure.

8. The apparatus of claim 7, wherein at least one of said worm-gear and worm element has a tooth or thread profile with a rounded tip section.

9. The apparatus of claim 8, wherein both of said worm-gear and worm element have a tooth or thread profile with a rounded tip section.

10. The apparatus of claim 7, wherein said worm element is mounted with its axis of rotation disposed generally vertically relative to the normal position of use of said data printer.

11. The apparatus of claim 10, wherein said worm-gear has an axis of rotation disposed generally horizontally relative to said normal position of use.

12. The data printer of claim 1, wherein said interlock means includes a clamping member which applies force to hold the paper-feed assembly clamped against portions of the frame structure.

13. A data printer with removable modular paper-feed assembly, comprising: a main support frame structure for the printer; removably mounted modular paper-feed assembly; print head means for printing characters on paper fed by said paper-feed assembly; means defining a guideway along which said removable paper-feed assembly is movable to an indexed operating position upon said support frame structure; said paper-feed assembly having means for engaging and moving paper stock in response to driven movement of a rotational gear element carried with the paper-feed assembly; a drive motor carried on said support frame structure and a driving worm element coupled to said motor to be rotated thereby, said worm element being fixed in position and having an axis of rotation disposed at an acute angle relative to at least portions of the said guideway for the removable paper-feed assembly; said paper-feed assembly being mountable upon said frame for printing operation by movement along said guideway, such movement carrying said gear element toward and into driving engagement with said worm along a path converging with the rotational axis of the worm element at said acute angle thereby substantially precluding clashing of the tooth tips on the gear element with the tip of the thread on the worm element.

14. The apparatus of claim 13, wherein said worm element is mounted with its axis of rotation at an acute angle relative to true vertical when said printer is in its normal position of use.

15. The apparatus of claim 14, wherein at least said portions of said guideway are disposed at an acute angle relative to true vertical when said printer is in its normal position of use.

16. The apparatus of claim 15, wherein said guideway portions are disposed at an acute angle relative to the axis of rotation of said worm element.

17. The apparatus of claim 14, wherein said acute angle of said worm element axis is on the order of from about 5° to 25°.

18. The apparatus of claim 17, wherein said acute angle is on the order of about 15°.

19. The apparatus of claim 15, wherein said acute angle of said guideway portions is on the order of from about 2° to 20°.

20. The apparatus of claim 19, wherein said acute angle is on the order of about 10°.

21. The apparatus of claim 16, wherein said acute angle is on the order of about 1° to 10°.

22. The apparatus of claim 21, wherein said acute angle is on the order of about 1° to 5°.

23. The apparatus of claim 13, wherein said guideway portions are disposed at an acute angle relative to the axis of rotation of said worm element, and wherein said acute angle is on the order of from about 1° to 10°.

24. The apparatus of claim 23, wherein said acute angle is on the order of about 1° to 5°.

25. The apparatus of claim 23, wherein at least one of said worm-gear and worm element has a tooth or thread profile with a rounded tip section.

26. The apparatus of claim 25, wherein both of said worm-gear and worm element have a tooth or thread profile with a rounded tip section.

27. The apparatus of claim 26, wherein said rounded tip section has a generally circular radius on the order of about one-third the average width of the tooth or thread.

* * * * *